US005460279A

United States Patent [19]

Emery et al.

[11] Patent Number: 5,460,279

[45] Date of Patent: Oct. 24, 1995

[54] COLLAPSIBLE SHELF ORGANIZER

[75] Inventors: William W. Emery, Berkeley Heights; Russell A. Fritts, Warren, both of N.J.

[73] Assignee: Better Sleep Manufacturing Co., Berkeley Heights, N.J.

[21] Appl. No.: 228,038

[22] Filed: Apr. 15, 1994

[51] Int. Cl.[6] ..... A47F 5/08

[52] U.S. Cl. ..... 211/106; 211/88; 211/119; 211/188; 220/481; 220/485

[58] Field of Search ..... 211/87, 88, 90, 211/106, 119, 181; 248/249; 220/485, 486, 476, 478, 480, 481

[56] References Cited

U.S. PATENT DOCUMENTS

| | | | |
|---|---|---|---|
| 3,269,556 | 8/1966 | Streater | 211/132 |
| 3,730,108 | 5/1973 | Stroh | 108/108 |
| 3,915,097 | 10/1975 | Young, Jr. | 108/6 |
| 4,846,430 | 7/1989 | Ke | 248/215 |
| 5,119,945 | 6/1992 | Wiggins | 211/59.2 |

FOREIGN PATENT DOCUMENTS

| | | | |
|---|---|---|---|
| 437522 | 4/1949 | Italy | 211/106 |

OTHER PUBLICATIONS

Artwire excerpts from catalog (three pages), Artwire Co., New Jersey.

Lee/Rowan excerpts from catalog (four pages), Lee/Rowan Inc., Missouri.

*Primary Examiner*—Blair M. Johnson
*Assistant Examiner*—Catherine S. Collins
*Attorney, Agent, or Firm*—Hopgood, Calimafde, Kalil & Judlowe

[57] ABSTRACT

A caddy organizer of collapsible construction for attachment to structures such as doors and walls, the caddy organizer comprising: at least two vertically extending frame members having at least two caddy support members extending therefrom, the caddy support members each having a terminal portion; each of the vertically extending frame members having operably connected thereto a caddy support element; and at least one caddy shelf disposed between the vertically extending frame members, the caddy shelf including a first shelf member having end portions adapted for releasable engagement with the terminal portion of the caddy support members and a second shelf member adapted to rest on the caddy support element of the vertically extending frame member.

2 Claims, 3 Drawing Sheets

COLLAPSIBLE SHELF ORGANIZER

FIELD OF THE INVENTION

The present invention relates to over the door shelf organizers. More particularly, the invention is a caddy organizer with a novel locking mechanism for collapsible transportation and assembly by the end-user.

BACKGROUND OF THE INVENTION

Organizing devices for hanging over doors or other structures which allow similar suspension are known. For example, Ke U.S. Pat. No. 4,846,430 discloses a door hanging organizer for suspending garments or towels.

Shelf or rack organizers for hanging over doors are also known. Most currently known over the door organizing devices are solid, one piece units in the form of coated steel wire structures having a frame and shelves. The single piece units are costly to transport, difficult to handle and require excessive storage and retail space.

Attempts have been made to produce "knocked down" or collapsible versions of over the door organizers. Generally, coated steel wire shelves are supported by vertical, metal tubing frame members which have holes drilled or punched through their sides. The holes permit ends of the steel wire to be inserted through the tubing, which the ends are capped with formed metal nuts. These joints are cheap and easy to manufacture, but they are unstable and the resulting assembly has poor structural integrity. This instability renders the entire assembled structure unsteady and susceptible to distortion, especially with movement such as swinging of the doors from which they suspend.

There is a need in the art for an over the door shelf organizer which overcomes the shortcomings and drawbacks of prior art designs.

OBJECTS OF THE INVENTION

It is an object of the present invention to provide a caddy organizer which is collapsible for cost-effective shipping, storage and display.

Another object of the present invention is to provide a collapsible shelf or caddy organizer with a novel locking mechanism for superior, overall structural integrity upon assembly.

Another object is to provide a collapsible caddy organizer with structural elements which contribute to a unique locking mechanism for ease of assembly and for providing rigid support once assembled.

These and other objects will be apparent from the present disclosure.

SUMMARY OF THE INVENTION

In general, the collapsed caddy organizer is comprised of at least four basic components including at least two vertically extending frame members and at least one caddy shelf. The collapsed components are assembled together by attaching the caddy shelves to the vertically extending frame members via structurally congruent elements which comprise a locking mechanism. The assembled caddy organizer has rigid, overall structural integrity with the vertically extending frame members firmly connected to the caddy shelves.

In the preferred embodiment, the locking mechanism in its elemental form comprises a substantially closed loop structure (also designated below as "top or bottom loop") and a shelf support element (designated below as a "grip lock rest"), both connected to a vertically extending frame member. The respective counterparts for the substantially closed loop structure and the shelf support element are a front end portion of a caddy shelf (designated below as a "small loop lock") and a rear shelf member on the caddy shelf (designated below as a "grip lock").

The caddy organizer is of collapsible construction for attachment to structures such as doors and walls. The caddy organizer has a first vertically extending frame member having first and second shelf support members. Each shelf support member extends from the first vertical frame member in a first plane. They are spaced a fixed distance apart and conclude in first and second terminal portions.

In the preferred embodiment, the terminal portions are substantially closed loop structures having first and second apertures, respectively. A first shelf support element operably connects to the first vertically extending frame member at a position along the first vertically extending frame member such that the first aperture and the first shelf support element are disposed along a first axis extending substantially perpendicular with respect to the first vertically extending frame member.

A second shelf support element operably connects to the first vertically extending frame member at a position along the first vertically extending frame member such that the second aperture and the second shelf support element are disposed along a second axis extending substantially perpendicular with respect to the first vertically extending frame member.

A second vertically extending frame member has extending therefrom third and fourth shelf support members which are spaced apart and disposed in a second plane substantially parallel to the first plane noted above. The third and fourth shelf support members terminate in third and fourth substantially closed loop structures having third and fourth apertures, respectively. A third shelf support element operably connects to the second vertically extending frame member at a position along the second vertically extending frame member such that the third aperture and the third shelf support element are disposed along a third axis extending substantially perpendicular with respect to the second vertically extending frame member.

A fourth shelf support element is operably connected to the second vertically extending frame member at a position along the second vertically extending frame member such that the fourth aperture and the fourth shelf support element are disposed along a fourth axis extending substantially perpendicular with respect to the second vertically extending frame member.

There is then provided a first caddy shelf having first, second and third shelf members with the first shelf member having first and second end portions adapted for passage through and releasable engagement with the first and third apertures formed in the first and third substantially closed loop structures. The second and third shelf members extend substantially perpendicular from the first and second end portions of the first shelf member and are adapted to rest on the first and third shelf support elements when the first and second end portions of the first caddy shelf are passed through and releasably engaged with the first and third apertures.

The first caddy shelf is supplemented with a second caddy shelf having fourth, fifth and sixth shelf members, with the fourth shelf member having first and second end portions adapted for passage through and releasable engagement with the second and fourth apertures formed in the second and fourth substantially closed loop structures. The fifth and sixth shelf members extend substantially perpendicular from the first and second end portions of the fourth shelf member when the first and second end portions of the fourth shelf member are passed through and releasably engage with the second and fourth apertures respectively.

Finally, a first and second attachment means is provided for attaching the first and second vertically extending frame members substantially vertical with respect to the structure from which the caddy organizer is intended to hang. The attachment means is illustrated below as hanger brackets, but one skilled in the art can readily discern that other attaching devices are viable including, but not limited to, suction cups or screws.

BRIEF DESCRIPTION OF THE DRAWINGS

For a more complete understanding of this invention, reference is made to the following detailed description of the preferred embodiment in connection with the accompanying drawings.

DETAILED DESCRIPTION OF THE PREFERRED EMBODIMENT

Figure 1:
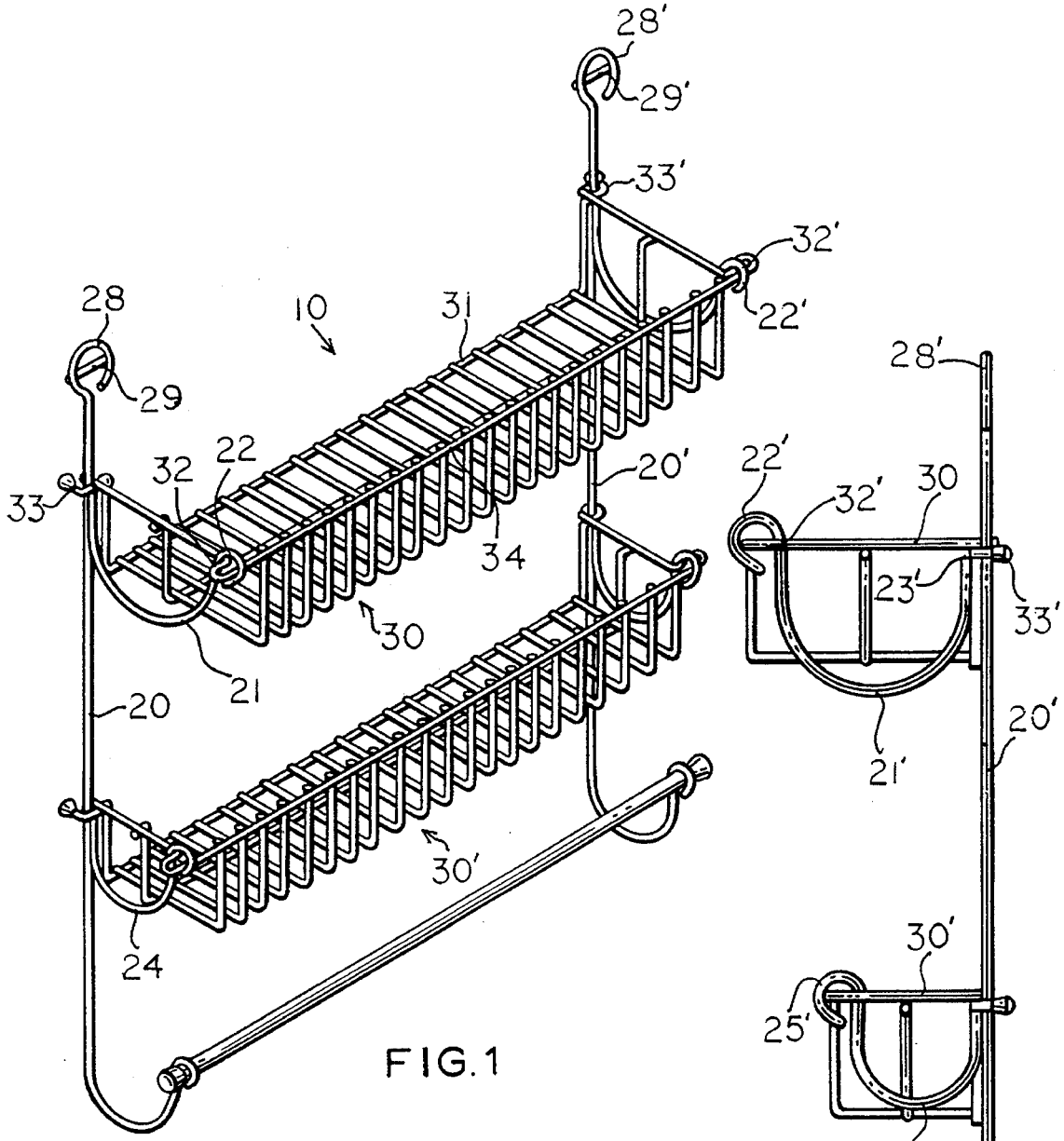
FIG. 1 is a perspective view of the collapsible shelf organizer showing the preferred embodiment of the present invention.

FIG. 1 illustrates the preferred embodiment of the present invention showing an assembled caddy organizer generally designated 10. The preferred embodiment is constructed principally of coated steel wire, but one skilled in the art can readily appreciate a variety of other possible materials suitable for such construction, especially after reviewing this disclosure.

Figure 3:
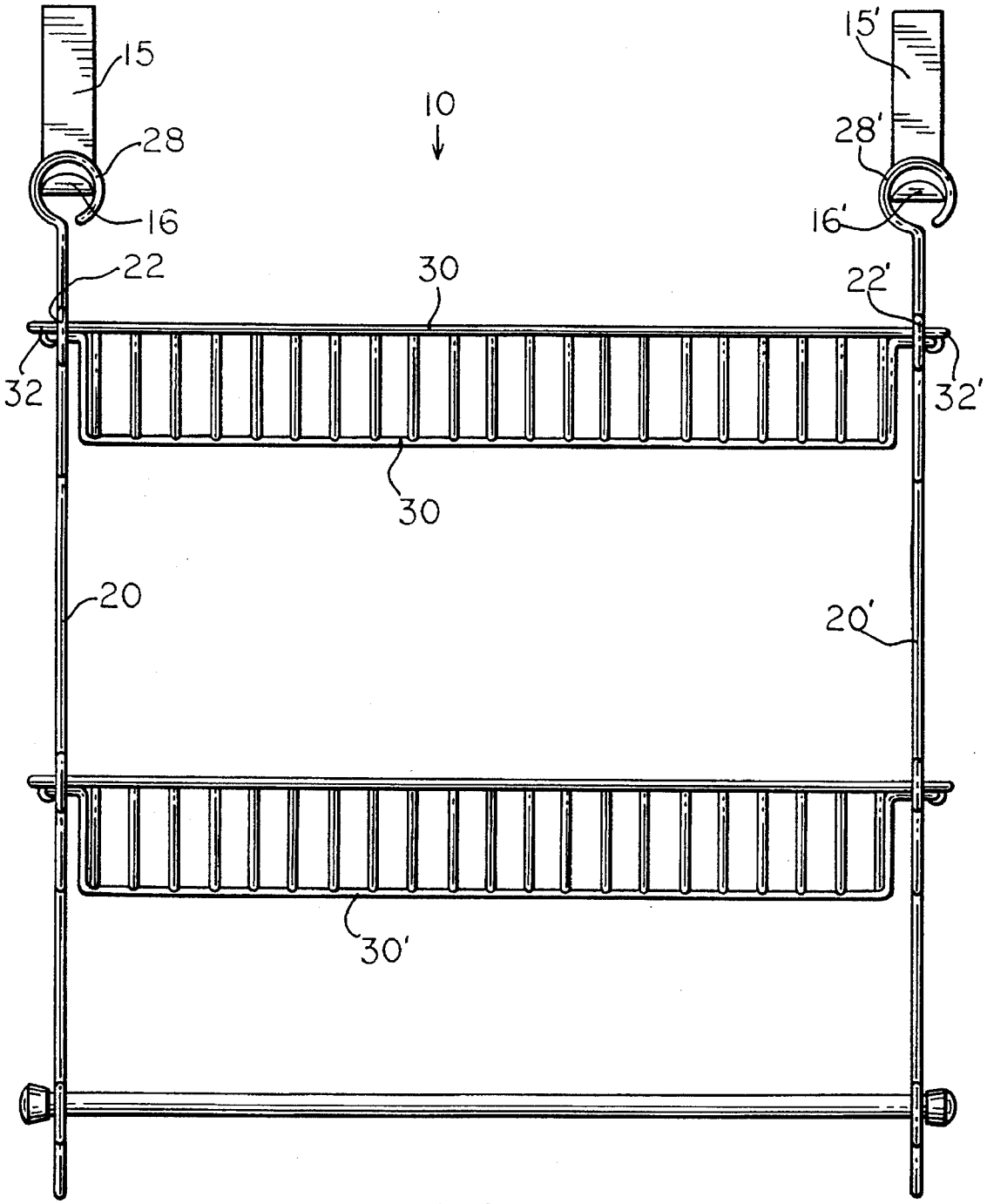
FIG. 3 is a frontal view of the shelf organizer attached to and suspending from hanger brackets.

Caddy organizer 10 comprises two vertically extending frame members 20 and 20' and two caddy shelves 30 and 30'. Vertical frame member 20', viewed as an example in FIG. 1, has at its uppermost portion a circular member designated 28'. Circular member 28' has in its diameter, cross wire 29' for attachment to semicircular end 16' of hanger bracket 15' (see FIG. 3).

Figure 2:
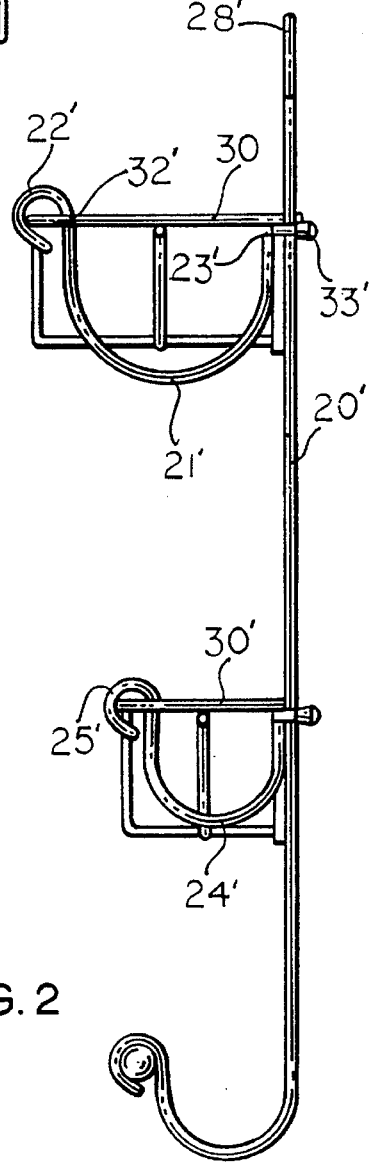
FIG. 2 is a side view of the collapsible shelf organizer showing overall structural integrity provided by the preferred locking mechanism in place after assembly.

Referring to FIG. 2, vertical frame member 20' has extending therefrom two caddy shelf support members 21' and 24' which extend in the same plane as vertical frame member 20'. Each support member extends from the plane of the vertical frame member and terminates in a substantially closed loop structure forming an aperture. The closed loops extending from caddy shelf support members 21' and 24' are designated top loop 22' and bottom loop 25', respectively. In the preferred embodiment as shown in FIG. 2, support members 21' and 24' are semicircular elements with an upwardly facing concavity. Other design variations are possible depending on the aesthetic qualities preferred, and all variations are within the scope and spirit of this disclosure.

Referring to FIG. 1, caddy shelf 30 has a first shelf member 34 (also referred to as front portion 34), a second shelf member 33 (also referred to as grip lock 33) and a third shelf member 33' (herein also grip lock 33'). First shelf member 34 has first and second end portions (also referred to as small loop locks 32 and 32') which are adapted for passage through and releasable engagement with apertures formed in substantially closed loop structures 22 and 22'.

Figure 4:
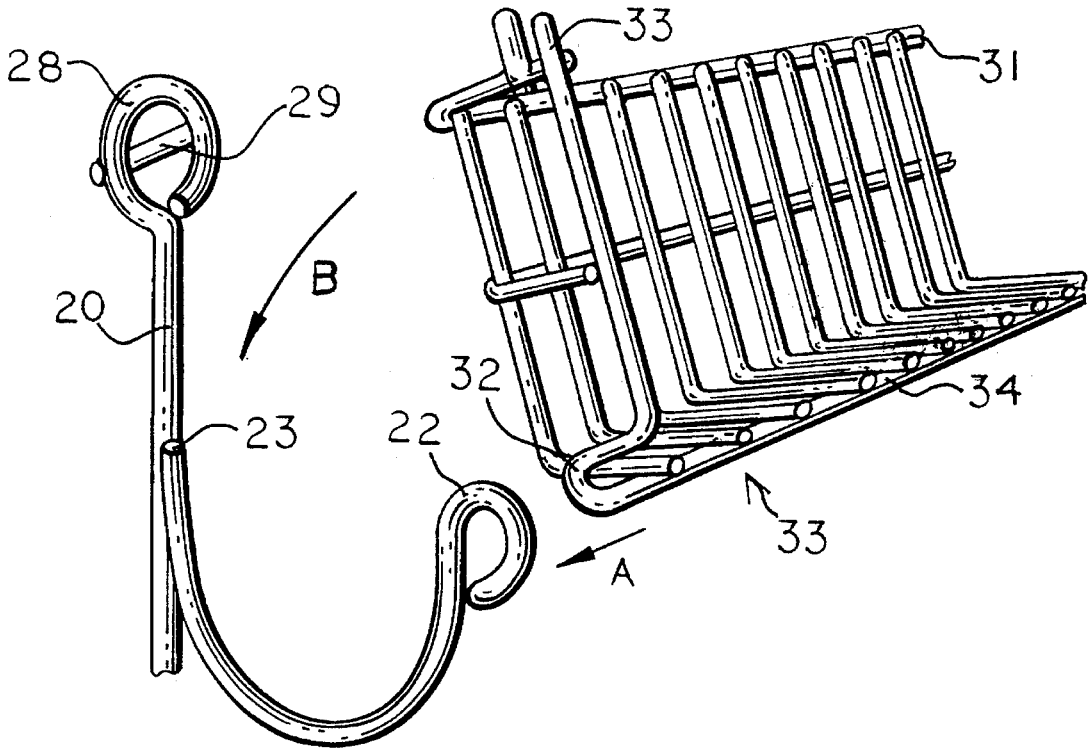
FIG. 4 is an isolated, cut-away view of the preferred locking mechanism with arrows showing the direction of attachment.

Referring to FIG. 4, caddy shelf 30, viewed as an example, has a small loop lock 32 extending horizontally from front portion 34 of caddy shelf 30. Small loop lock 32 is intended to fit through the aperture formed by top closed loop structure 22 of caddy shelf support member 21 as indicated by the arrow A. Rear portion 31 of caddy shelf 30 comprises second shelf member or forked grip lock 33 which extends in a perpendicular direction from the plane of rear portion 31. Grip lock 33 is designed to repose firmly on shelf support element or grip lock rest 23. Grip lock rest 23 is formed at the weld joint between the end opposite top loop 22 on caddy shelf support member 21 and vertical frame member 20.

To assemble shelf organizer 10, hanger brackets 15 and 15' (see FIG. 3) are placed over the top of a suitable structure such as a door. Referring to FIG. 1 in conjunction with FIG. 3, cross wires 29 and 29' on the upper portions of vertical frame member 20 and 20' are slipped into semicircular ends 16 and 16' of hanger brackets 15 and 15'. After spacing and centering the suspended vertical frame members 20 and 20', caddy shelf 30 is placed between the vertical support frames and tipped so that rear portion 31 of shelf 30 points in an upward direction as shown in FIG. 4.

Referring to FIG. 4, small loop lock 32, extending horizontally from front portion 34 of caddy shelf 30, is slipped through top loop lock 22 of support frame 20 as indicated by the arrow A. This is repeated on the opposite end of caddy shelf 30, with small loop lock 32' extending from caddy shelf 30 slipped through top loop lock 22' of support frame 20' (see FIG. 2).

Figure 5:
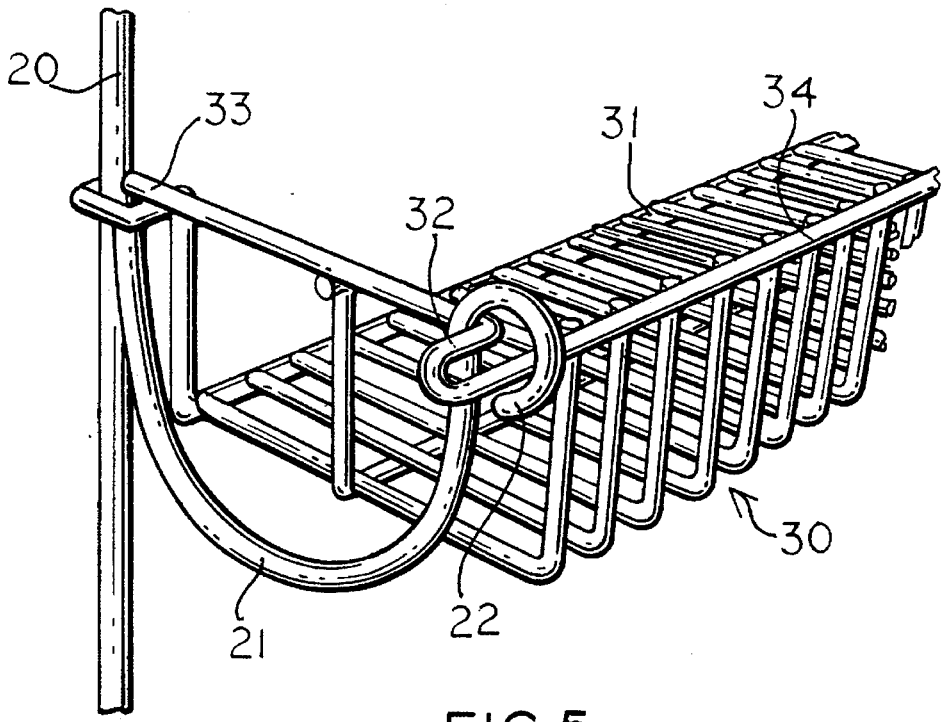
FIG. 5 is an isolated, cut-away view of the preferred locking mechanism after assembly of the shelf organizer.

Once loop locks 32 and 32' are in place, rear portion 31 of caddy shelf 30 is allowed to descend in a counter clockwise direction following arrow B until grip lock 33 rests firmly on grip lock rest 23 as shown in FIGS. 4 and 5. This is repeated simultaneously on the opposite end of caddy shelf 30, with loop locks 32 and 32' rotating within top loop locks 22 and 22' and until grip lock 33' is firmly on grip lock rest 23' as shown in FIG. 2. All of the above steps are repeated for caddy shelf 30'.

The illustrated preferred embodiment has proven to be useful in many applications for the caddy art. Further modifications based on the disclosure will occur to persons skilled in the art. Such modifications are within the scope and spirit of the present invention as defined by the following claims.

What is claimed is:

1. A caddy organizer of collapsible construction for attachment to structures such as doors and walls, said caddy organizer comprising:

a first vertically extending frame member having first and second shelf support members each extending from said first vertically extending frame member, said first and second shelf support members being spaced apart and disposed in a first plane and terminating in first and second substantially closed loop structures having first and second apertures, respectively;

a first shelf support element operably connected to said first vertically extending frame member at a position along said first vertically extending frame member such that said first aperture and said first shelf support element are disposed along a first axis extending substantially perpendicular with respect to said first vertically extending frame member;

a second shelf support element operably connected to said first vertically extending frame member at a position along said first vertically extending frame member such that said second aperture and said second shelf support element are disposed along a second axis extending substantially perpendicular with respect to said first vertically extending frame member;

a second vertically extending frame member having third and fourth shelf support members each extending from said second vertically extending frame member, said third and fourth shelf support members being spaced apart and disposed in a second plane substantially parallel to said first plane, and said third and fourth shelf support members terminating in third and fourth substantially closed loop structures having third and fourth apertures, respectively;

a third shelf support element operably connected to said second vertically extending frame member at a position along said second vertically extending frame member such that said third aperture and said third shelf support element are disposed along a third axis extending substantially perpendicular with respect to said second vertically extending frame member;

a fourth shelf support element operably connected to said second vertically extending frame member at a position along said second vertically extending frame member such that said fourth aperture and said fourth shelf support element are disposed along a fourth axis extending substantially perpendicular with respect to said second vertically extending frame member;

a first caddy shelf having first, second and third shelf members, said first shelf member having first and second end portions adapted for passage through and releasable engagement with said first and third apertures formed in said first and third substantially closed loop structures, and said second and third shelf members extending substantially perpendicular from said first and second end portions and adapted to rest upon said first and third shelf support elements when the first and second end portions of said first caddy shelf are passed through and releasably engaged with said first and third apertures;

a second caddy shelf having fourth, fifth and sixth shelf members, said fourth shelf member having first and second end portions adapted for passage through and releasable engagement with said second and fourth apertures formed in said second and fourth substantially closed loop structures, and said fifth and sixth shelf members extending substantially perpendicular from said first and second end portions of said fourth shelf member when said first and second end portions of said fourth shelf member are passed through and releasably engaged with said second and fourth apertures respectively;

first and second attachment means for attaching said first and second vertically extending frame members substantially vertical with respect to said attachment structures such as doors and walls.

2. The caddy organizer of claim 1 comprised of coated steel wire.

* * * * *